United States Patent [19]

Cassel

[11] 4,309,710

[45] Jan. 5, 1982

[54] MULTI-LOBE ANTENNA HAVING A DISC-SHAPED LUNEBERG LENS

[75] Inventor: Knut E. Cassel, Järfälla, Sweden

[73] Assignee: U.S. Philips Corporation, New York, N.Y.

[21] Appl. No.: 118,814

[22] Filed: Feb. 5, 1980

[30] Foreign Application Priority Data

Feb. 6, 1979 [SE] Sweden ..... 7901046

[51] Int. Cl.[3] ..... H01Q 19/06

[52] U.S. Cl. ..... 343/754; 343/755; 343/911 L

[58] Field of Search ..... 343/753, 754, 755, 909, 343/911 R, 911 L

[56] References Cited

U.S. PATENT DOCUMENTS 2,871,477 1/1959 Hatkin ..... 343/756

2,989,746 6/1961 Ramsay ..... 343/756

3,213,454 10/1965 Ringenbach ..... 343/754

*Primary Examiner*—Eli Lieberman

*Attorney, Agent, or Firm*—Thomas A. Briody; David R. Treacy; Robert J. Kraus

[57] ABSTRACT

An antenna, preferably operable in the microwave range, comprising a disc-shaped lens having a radially varying refraction index, and having feeders distributed around the circumference. Each feeder is in the shape of a thin wire having a projection which, as seen radially relative to the center of the disc, forms a straight line inclined 45° relative to the plane sides of the disc. All feeders are inclined in the same direction relative to the center of the disc and thus all diametrically-opposed feeders are oriented substantially perpendicular to each other. Because of this orientation, radiation focussed by the lens passes to and from any active feeder without being substantially disturbed by other feeders, and a plurality of feeders can be active simultaneously.

4 Claims, 3 Drawing Figures

MULTI-LOBE ANTENNA HAVING A DISC-SHAPED LUNEBERG LENS

BACKGROUND OF THE INVENTION

The invention relates to an antenna, preferably operable in the micro wave range, comprising a Luneberg lens. The lens in the form of a round disc-shaped element, for example of dilectric material, having a radially varying reflection index. The lens is covered on at least one of its plane sides by a conducting plane. Feeders are distributed around the circumference of the lens for transmitting and receiving electromagnetic energy passing through the lens and emerging from or entering into, respectively, the part of the circumference of the lens situated opposite an active feeder.

Known antennas of this kind are either constructed for polarization of the E-vector perpendicular to the plane of the lens or polarization of the E-vector in the plane of the lens. If the lens is oriented horizontally, as is usually the case, the former polarization can be called vertical and the latter horizontal.

A problem with such an antenna, where the whole lens circumference is surrounded by feeders, is that the radiation transmitted from or received by each individual feeder must pass through the diametrically opposed feeder, which attenuates the radiation. In other words, the diametrically opposed feeder "hides" the transmitting/receiving feeder. Each feeder must therefore present a small geometric projection surface, as seen in a plane perpendicular to the propagation direction of the radiation in the lens. Besides the geometric extension in a plane perpendicular to the propagation direction for a given wave, it is also possible to define for each feeder an "effective antenna area" in the plane, which must also be small so that the feeder is not "hidden". This effective antenna area depends i.a. on the load impedance of the feeder and can be varied by electrical switching operations.

In known lens antenna constructions with feeders distributed around the circumference thereof only one single feeder is active at a time. Those feeders which have a hiding effect on the active feeder can be switched electrically so that the effective antenna areas thereof will be small. These switched feeders cannot of course, be used either as receiving or transmitting elements as long as they must have a small hiding influence on the active feeder.

SUMMARY OF THE INVENTION

The object of the invention is to provide an antenna of the above described type, which comprises feeders distributed around the whole circumference, but in which the feeders which are situated opposite an active feeder do not substantially attenuate radiation from or to the active feeder, so that in an extreme application all feeders can be used simultaneously.

According to the invention this is achieved by providing feeders in the form of thin wires, each situated in a plane which—as seen radially for each individual feeder—forms an angle of substantially 45° with the plane of the disc-shaped lens element. All feeders are inclined in the same direction so that for each individual feeder, the feeders situated diametrically opposite thereof are situated substantially perpendicular to the respective feeder.

The radiation from such an antenna will be polarized 45° relative to the antenna plane, which is usually horizontal. Because the opposite feeders are always situated substantially perpendicular to the E-vector of the radiation from or to an active feeder, these "hiding feeders" will not substantially disturb radiation. Furthermore, in many applications it may be an advantage to have an antenna operating with radiation polarized at 45° because such radiation has components present both in the horizontal and vertical directions. The advantage of being able to simultaneously receive and transmit, respectively, in both polarisation directions, without switching, is offset by a small (3 dB) decrease in the antenna gain factor as compared with an antenna which can be switched between vertical or horizontal polarization.

In order to ensure that the radiation component which is parallel to the plane of the lens can pass through the lens, it is necessary that the distance between the conductive planes is larger than the half wave length of the radiation. The distance must be larger than the half wave length for the lowest frequency. For the lens to have the desired focusing effect, it is also necessary that the distance between the conductive metal planes be larger than the half wave length of the lowest radiation frequency. In order to reduce the total thickness of the lens, i.e., the distance between the conductive planes, and to achieve the advantages resulting from a small lens thickness, a part of the distance between the conductive planes may consist of air or a dielectric with corresponding dielectric constant, as described in the Swedish patent application No. 7901047-6.

Theoretically only one single feeder is situated exactly perpendicular to the E-field of the wave from any active feeder, namely that feeder which is situated exactly diametrically opposite the active feeder. The remaining feeders on the opposite side have an inclination against the E-field which deviates from 90°, the deviation from 90° increasing with the distance from the diametrically opposite feeder. The feeders situated at the outermost parts of the opposite half of the lens will have an attenuating influence on the radiation from the active feeder. In order to minimize this influence it is possible, in accordance with another feature of the invention to shape each feeder such that the lobe width of the radiation beam associated therewith does not include the outermost parts of the lens as seen in relation to the centrum line of the lobe.

A good lobe shape and antenna gain is obtained if the wire feeders are shaped substantially, symmetrical and consist of two bent wire parts which are interconnected in the symmetry point, the feading being effected in said point.

As a result of such symmetric construction of the feeders, and feading in the symmetry point a strong suppression of higher modes is achieved. All modes having a minimum at the center are suppressed as a result of the geometrically symmetrical feeding.

DESCRIPTION OF THE PREFERRED EMBODIMENT

Figure 1:
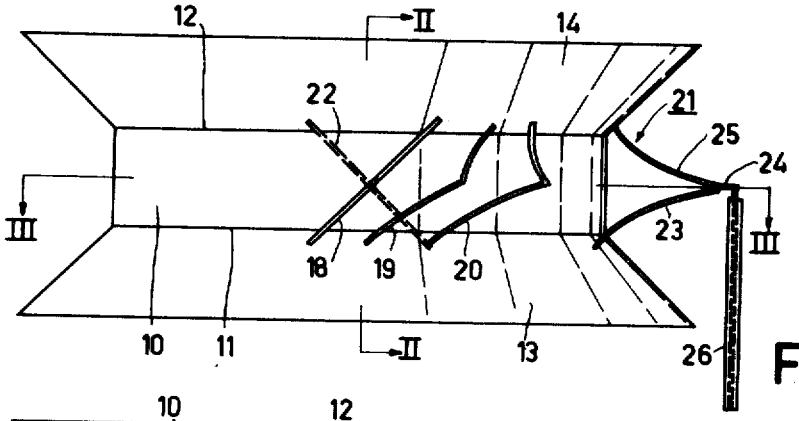
FIG. 1 shows a schematic side view of a Luneberg lens-type antenna according to the invention, in which for the sake of clarity only a few feeders are shown.
Figure 2:
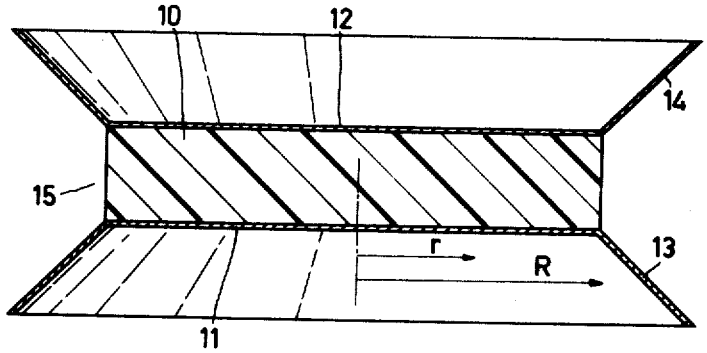
FIG. 2 shows a vertical section view through the antenna of FIG. 1 taken along the line II—II, the feeders being omitted.

The illustrated antenna lens comprises a circular disc 10 of dielectric material. The refraction index (dielectric constant) of the lens, and the delay for electromagnetic radiation, increases toward the center of the disc, and two round metallic plates 11 and 12 are situated on each side of the disc 10. At the circumference, each metallic plate 11, 12 is continued as an oblique collar 13, 14 shaped as an envelope surface of a truncated cone. The two collars, between themselves, define a funnel-shaped space 15 extending around the circumference. The dielectric disc 10 has a thickness equal to the distance between the plates so that the space between the plates is completely filled by dielectric.

The dielectric disc 10 may, for example, be optimally dimensioned for vertically polarized radiation in which case the dielectricity constant $\epsilon(r)$ fulfils the relationship:

$$\epsilon(r)=2-(r/R)^2$$

where r is the distance from the center of the disc and R is the radius of the disc.

A large number of feeders are distributed around the circumference of the round dielectric disc 10, of which only a few, designated 18, 19, 20, 21 and 22, are shown in the drawing. Of these feeders the feeder 18 is the central feeder of the feeders arranged on the front half of the disc 10, while 19, 20 are the two feeders which are closest to the feeder 18 as seen in the counter-clock wise direction along the circumference of the disc 10. The feeder 21 is the feeder situated furthest to the right in FIG. 1, and is thus situated in an angle of 90° from the central feeder 18 in relation to the center of the disc 10. The feeder 22 is situated diametrically opposite the feeder 18, i.e. in center of the rear half of the disc 10. The feeder 18 is, as shown in FIG. 1, visible in the shape of its projection as seen in the radial direction, i.e. in the direction from the center of the feeder to the center of the disc 10. This is also true of the feeder 22, while the feeder 21 is visible in the shape of its projection from the side.

It is evident from FIG. 1 that each feeder has the shape of a thin wire which is so bent (see the feeder 21 situated outermost to the right in FIG. 1) that it follows (from the place of attachment in the lower metallic plate 11 or its associated collar 13) a bend 23 outwardly to a point 24, where it is folded almost 180° and then follows a similar bend 25 inwardly to the point of attachment in the upper metal plate 12 or its collar 14. The feeder is symmetric in relation to the point 24, even if the two bent parts 23 and 25 are not equally long. It is also evident from FIG. 1 (see the central feeder 18) that the bent parts of each feeder are situated in a plane which, as seen radially, is inclined 45° relative to the radial plane of the active feeder (and also relative to the lens plane). The expression "radial plane" is to be understood as the plane which coincides with the center of the active feeder and the center of the disc 10. All feeders are inclined in the same direction to the respective radial plane, which means that any diametrically-opposite feeders are perpendicular with each other, as is evident from FIG. 1 for the feeders 18 and 22.

Feeding is effected at the symmetry point or center point 24, which can be connected to the center lead of a coaxial cable 26, as indicated in FIG. 1 for the feeder 21. The coaxial cable must be thin and so situated that it disturbs the radiation passage in as little as possible.

As result of the inclination of the feeders the radiation from each individual feeder will be polarized 45° relative to the vertical axis (if the lens is situated horizontally). The opposite feeders are oriented substantially perpendicular to the polarization direction of an active feeder and thus will produce minimal attenuation of the radiation from the active feeder. As a result of this, all feeders can be active simultaneously without any switching operation being necessary. To enable the horizontal component of the radiation to penetrate through the lens the distance between the conductive plates 11, 12 the dielectric constant of the disc 10 must be larger than half the wavelength for the lowest frequency.

Figure 3:
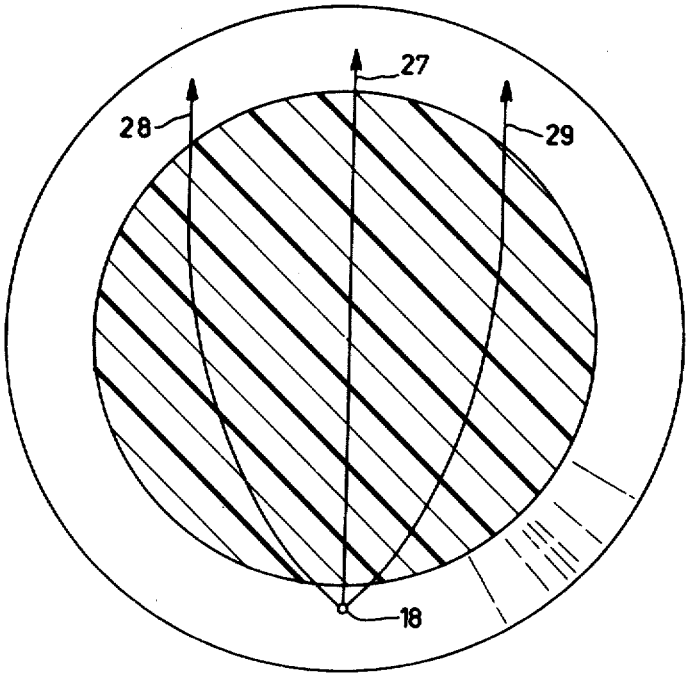
FIG. 3 shows a horizontal sectional view taken along the line III—III in FIG. 1 without feeders and with three radiation paths shown.

The shape and the dimensions of each individual feeder must be made such that the required lobe width is achieved for the radiation beam associated therewith. FIG. 3 shows the central ray for the feeder 18, represented by the line 27, and two of the outer rays 28, 29 of the main lobe. As shown, the outermost parts of the lens are not utilized. The reason for this is i.a. that those feeders which are situated at the outermost parts have an inclination against the polarization direction, which deviates from 90°, and the feeders situated at these parts would cause attenuation.

An advantage of the symmetric arrangement of the feeders is that higher modes are suppressed. The feeders may, in principle, also be shaped in other suitable manners within the scope of the invention. For example they could have the shape of a wire or a wire loop which is fed at one end. One of the conductive planes may also be omitted, in which case some leakage radiation emerges from the lens side where the conductive plane is missing.

What is claimed is:

1. An antenna, operable within the micro wave range, comprising a round, disc-shaped lens with a radially varying refraction index, covered on at least one of the plane sides by a conductor, and comprising feeders distributed around the circumference for transmission and reception of electromagnetic energy passing through the lens, said feeders having the shape of thin wires, each feeder being situated in a plane which—as seen radially for each individual feeder—forms an angle of substantially 45° with the plane sides of the lens, all the wire-shaped feeders being inclined in the same direction so that for each individual feeder the feeder situated diametrically opposite thereof is oriented substantially perpendicular thereto.

2. An antenna as in claim 1, characterized in that each feeder is shaped such that the lobe width of the radiation beam associated therewith, in a direction parallel to said plane sides of the lens, is smaller than the diameter of the lens.

3. An antenna as in claim 1 or 2, characterized in that each feeder has a substantially symmetrical shape, in its plane, and comprises two bent wire parts interconnected in the symmetry point, feeding being effected at said symmetry point.

4. An antenna as in claim 1, and further comprising an extension of each conductor in the form of a truncated cone forming an oblique angle with the conductor.

* * * * *